US005921583A

United States Patent [19]

Matsumoto et al.

[11] Patent Number: 5,921,583

[45] Date of Patent: Jul. 13, 1999

[54] ANTITHEFT LABEL

[75] Inventors: Tatsuya Matsumoto; Toshiyuki Hirano; Norio Tachioka; Hitomi Beppu, all of Kyoto, Japan

[73] Assignee: Unitika, Ltd., Hyogo, Japan

[21] Appl. No.: 08/745,919

[22] Filed: Nov. 8, 1996

[30] Foreign Application Priority Data

Nov. 8, 1995 [JP] Japan ..... 7-289640
Jul. 2, 1996 [JP] Japan ..... 8-172093

[51] Int. Cl.[6] ..... G08B 13/24

[52] U.S. Cl. ..... 283/81; 428/611; 428/928; 340/551; 340/572

[58] Field of Search ..... 428/607, 611, 428/686, 928, 626; 340/551, 572; 148/108, 518; 204/192.2; 283/81, 101

[56] References Cited

U.S. PATENT DOCUMENTS

| | | | |
|---|---|---|---|
| 3,631,442 | 12/1971 | Fearon . | |
| 4,660,025 | 4/1987 | Humphrey | 340/572 |
| 4,686,516 | 8/1987 | Humphrey | 340/572 |
| 4,797,658 | 1/1989 | Humphrey | 340/551 |
| 5,519,379 | 5/1996 | Ho et al. . | |
| 5,560,970 | 10/1996 | Ludebuhl | 428/41.9 |
| 5,605,768 | 2/1997 | Furukawa et al. | 428/611 |
| 5,650,236 | 7/1997 | Hirano et al. | 428/611 |

FOREIGN PATENT DOCUMENTS

| | | | |
|---|---|---|---|
| A1 4323883 | 1/1995 | Germany . | |
| 4-195384 | 7/1992 | Japan | G06K 19/10 |
| 4195384 | 7/1992 | Japan . | |
| A 2167627 | 5/1986 | United Kingdom . | |

*Primary Examiner*—Frances Han
*Attorney, Agent, or Firm*—Sughrue, Mion, Zinn Macpeak & Seas, PLLC

[57] ABSTRACT

An antitheft label which generates a high Barkhausen inversion when subjected to a magnetic field. The antitheft label comprises a laminate of upper and lower tape bases each having an inner laminated surface and an outer surface, a first adhesive layer disposed on the inner surface of the upper tape base, a second adhesive layer disposed on the inner surface of said lower tape base, a pulse-generating magnetic wire and first and second magnetic thin ribbons disposed on opposite ends of the magnetic wire. The magnetic wire and magnetic thin ribbons are arranged between the upper and lower tape bases.

20 Claims, 4 Drawing Sheets

ANTITHEFT LABEL

BACKGROUND OF THE INVENTION

1. Field of the Invention

The present invention relates to an antitheft label which can be affixed to an article of merchandise to detect merchandise that is shoplifted from a store and to thereby prevent theft.

2. Description of the Related Art

It has heretofore been known that a monitor label can be affixed to merchandise to prevent shoplifting.

Generally, when a label affixed to merchandise enters a label detection zone (a zone developed by an electric, electromagnetic or magnetic field having a certain magnitude) formed by transmitting antennae installed at the doorway of a store, a specific signal is generated which is then detected by a receiving antenna installed in the same location as the transmitting antennae to thereby sound an alarm.

In one such system, an alternating magnetic field is applied to a high permeability magnetic thin ribbon or a magnetic wire. This generates in the detection zone a disturbance in the magnetic field or an output pulse having a harmonic component which is then detected. In another system, a label comprising a combination of a coil made of aluminum foil and a capacitor made of an aluminum foil is employed. When an electric field is externally applied, the label resonates and this resonance is hen detected.

Among these systems, a label employing a amorphous magnetic wire having Large Barkhausen Jump is advantageous in that it can form a system which operates at high sensitivity with little misdetection (U.S. Pat. Nos. 4,660,025, 4,686,516, and 4,797,658).

Further, JP-A-4-195384 (The term "JP-A" as used herein means an "Unexamined Japanese Patent Publication") discloses a magnetic marker utilizing Large Barkhausen Jump comprising a amorphous magnetic wire including another magnetic material having a smaller coercive force which this disposed on the ends of the magnetic wire. In this arrangement, a magnetic marker having a small size such that a pulse-generating magnetic wire alone would not exhibit Large Barkhausen Jump is said to provide good Large Barkhausen Jump. Furthermore, the magnetic marker can be miniaturized to an entire length of about 60 mm if a magnetic wire having a diameter of 120 $\mu$m is used.

Such a magnetic marker is used as an antitheft label. Heretofore, such a label has comprised a detection member such as the foregoing high permeability magnetic thin ribbon (a member which generates a specific signal when subjected to a magnetic, electric or electromagnetic field), laminated with at least two tape basis. In general, one of the two tape bases is disposed on the side of the label affixed to an article of merchandise (herein after referred to-as a "sticking side") and the other tape base disposed opposite the former tape base on the label surface side (hereinafter referred to as "surface side"). The detection member is interposed between the two base tapes.

A film or paper is used as the sticking side tape base. The surface side tape base is usually used a transparent or semi-transparent film, or a white or colored paper on which price, notice, etc. are optionally printed.

Furthermore, in order to laminate the detection member with these tape bases, one of the sticking side tape base and the surface side tape base has an adhesive layer on the side thereof with which the detection member is laminated (laminated side). moreover, the sticking side tape base has an adhesive layer so that it can be affixed to merchandise.

The magnetic marker (antitheft label) disclosed in the above cited JP-A-4-195384 comprises a magnetic wire having Large Barkhausen Jump and magnetic thin ribbons (magnetic sheet) having a smaller coercive force Hc than the magnetic wire attached to both ends of the magnetic wire. However, the Large Barkhausen Jump of the magnetic marker can easily change depending on the contact condition of the magnetic wire with the magnetic thin ribbon. The magnetic marker loses its Large Barkhausen Jump or exhibits unstable diamagnetism over time or the actual working conditions. Therefore, the magnetic marker is disadvantageous in that it varies widely in its properties as an antitheft label. For example, if there is a gap between the magnetic wire and the magnetic thin ribbon or if the surface of the magnetic thin ribbon or magnetic wire is not smooth, then there is insufficient contact between the two components. These conditions give rise to unstable Large Barkhausen Jump. Similarly, if the antitheft label is affixed to articles having various curvatures, the magnetic wire and the magnetic thin ribbon are not in fixed contact with one another, thus giving rise to unstable Large Barkhausen Jump.

The term "instability in Large Barkhausen Jump" as used herein means a defect in the BH loop such as process of magnetization which deteriorates the Large Barkhausen Jump. The results in the drawing of a minor loop, an extreme rise in the critical field (hereinafter referred to as "H*") and the generation of jitter (an irregular loop disturbance).

Such instability in Large Barkhausen Jump markedly deteriorates the detectability of the antitheft label by a detection system.

For example, if the label no longer exhibits Large Barkhausen Jump, the pulse voltage output or the harmonics generated by the label is reduced. If H* rises, it is difficult to detect the antitheft label in a small exciting magnetic field. Furthermore, if jitter is generated, it is difficult to distinguish the signal of the antitheft label from noise. In any case, the detection sensitivity is lowered or the zone of the detection zone is decreased.

Furthermore, if a transparent film or white paper as usual is used as the surface side tape base, it is disadvantageous in that the detection member can be easily recognized when the label is affixed to merchandise. Once the detection member is recognized, one can know that the label is an antitheft label. This means that if a shoplifter peels the label off the merchandise or locates other merchandise free of such a label, it becomes easy to shoplift. In other words, such a label affixed to merchandise is unlikely to fulfill its antitheft function.

In order to solve these problems, a semi-transparent film may be used as the surface side tape base instead of a transparent film. However, even a semi-transparent film cannot fully hide the detection member. Furthermore, such a semi-transparent film is a special film which adds to the cost of the label.

Furthermore, the thickness of a paper, if a paper is used as the surface side tape base, may be increased. However, the increasing in the thickness of the paper not only adds to the cost but also the volume of the label. The increase in the volume of the label impairs the operating efficiency of the labelling machine or restricts the kind of merchandise to which the label can be affixed.

The use of a colored paper may be proposed. However, the color of such a colored paper which can hide the member to be detected may be limited, for example, to blue. On the other hand, the label can form a striking contrast with some colors of the merchandise to which it is affixed. Furthermore, if the color of the surface side tape base is limited, the various needs of retail stores cannot be met.

On the other hand, if a label including a sticking side tape base comprising a film or paper which has heretofore been used is affixed to transparent merchandise or the like, it is disadvantageous in that the detection member can be recognized when viewed from the sticking side of the label through the merchandise.

Furthermore, JP-A-7-140898 discloses an antitheft label comprising a display support (a surface side tape base) having on the side thereof opposed to a protective element (laminated side) a layer having a transparency which is low enough to prevent the protective element from being recognized with respect to visible light rays. The low transparency layer of JP-A-7-140898 is an opaque color sheet.

However, the use of the opaque color sheet as an extra component not only added to the cost, but also the thickness of the entire label. The increase in the thickness of the label may impair the operating efficiency of the labelling machine.

SUMMARY OF THE INVENTION

It is an object of the present invention is to provide an antitheft label which exhibits invariably Large Barkhausen Jump over time or under various working conditions.

It is another object of the present invention is to provide an antitheft label having a detection member which is concealed (that is, hidden from external view) and which allows for printing price information, a bar code, etc.

The inventors extensively studied the above problems of the prior art. As a result the present inventors discovered that antitheft label comprising a pulse-generating magnetic wire and magnetic thin ribbons disposed on the both ends thereof in close contact therewith, which pulse-generating magnetic wire and magnetic thin ribbons are laminated with at least two tape bases, and wherein the at least the two tape bases each comprise an adhesive layer on the sides thereof with which the magnetic wire and magnetic thin ribbons are laminated, reliably generates Large Barkhausen Jump over time or under various working conditions. The present inventors also discovered that if the adhesive layer disposed on the laminated side of the sticking side tape base contains a pigment, the detection member (i.e., the magnetic wire and magnetic thin ribbons), can be visually concealed. The present inventors further discovered that the use of a paper as the label surface side tape base allows for printing price information etc. The present invention has been achieved based on the above findings.

Thus in a first embodiment, the present invention provides an antitheft label which generates a large Barkhausen inversion when subjected to a magnetic field, the antitheft label comprising a laminate of upper and lower tape bases each having an inner laminated surface and an outer surface, a first adhesive layer disposed on the inner surface of the upper tape base, a second adhesive layer disposed on the inner surface of the lower tape base, a pulse-generating magnetic wire and first and second magnetic thin ribbons disposed on opposite ends of the magnetic wire, wherein the magnetic wire and magnetic thin ribbons are arranged between the upper and lower tape bases.

In a second embodiment, the present invention provides an antitheft label as defined above, wherein the lower tape base side of the antitheft label is adapted for affixing to an article of merchandise, and the second adhesive layer disposed on the inner surface of the lower tape base contains a pigment.

In the third embodiment, the present invention provides an antitheft label as defined above, wherein the upper tape base comprises a paper.

The antitheft label of the present invention reliably exhibits Large Barkhausen Jump over time and under various working conditions.

Furthermore, the antitheft label of the present invention can conceal the detection member from view and allows for the printing of price information, a bar bode, etc. thereon.

BRIEF DESCRIPTION OF THE DRAWINGS

In the accompanying drawings.

Figure 1:
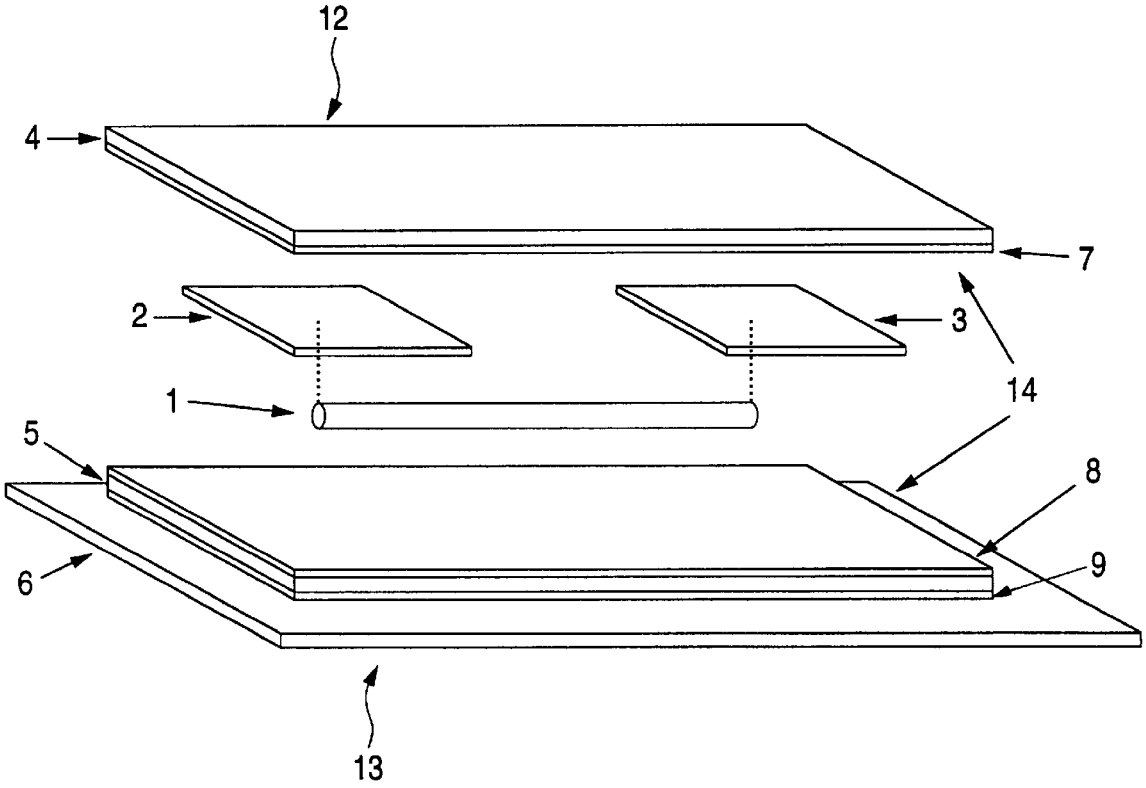
FIG. 1 is a schematic perspective view illustrating an embodiment of the antitheft label of the present invention.

The reference numerals of FIGS. 1–11 are described below.

| | |
|---|---|
| 1 | Magnetic wire |
| 2, 3 | Magnetic thin ribbon |
| 4 | Tape base on the surface side (upper tape base) of the label |
| 5 | Tape base on the sticking side (lower tape base) of the label |
| 6 | Release paper |
| 7, 8 | Adhesive layer on the laminated side (inner surface) of tape bases 4 and 5, respectively |
| 9 | Adhesive layer on the sticking side (outer surface) of the lower tape base |
| 10 | Label roll |
| 11 | Antitheft label |

-continued

| | |
|---|---|
| 12 | Surface side of the label |
| 13 | Sticking side of the label |
| 14 | Laminated side |

DETAILED DESCRIPTION OF THE INVENTION

The present invention will be described in reference to the accompanying drawings.

FIG. 1 is a schematic perspective view illustrating an embodiment of the antitheft label of the present invention.

In FIG. 1, a magnetic wire 1 which acts as a pulse-generating element and magnetic thin ribbons 2 and 3 disposed on the both ends thereof in close contact with the magnetic wire 1 are laminated with two tape bases 4 and 5 having adhesive layers 7, 8 and 9. Disposed on the lower surface of the tape base 5 is a release paper 6 treated for easy release.

The tape base 4 is disposed on the surface side of the label. The upper surface of the tape base 4 is exposed.

The tape base 5 is disposed on the side of the label that is to be affixed to the merchandise.

Once the release paper 6 is peeled off the lower surface of the tape base 5, the label can be affixed to the merchandise.

In order to allow the antitheft label of the present invention to exhibit invariably Large Barkhausen Jump over time and under various working conditions, adhesive layers 7 and 8 must be disposed on the laminated (the inner facing) sides of tape base 4 and tape base 5, respectively. If the adhesive layer is provided only on the tape base 4 disposed on the magnetic thin ribbons 2 and 3, air accumulates in a contact portion of the magnetic wire 1 having no adhesive layer and the magnetic thin ribbons 2 and 3. When such a label is affixed to an article, if the magnetic wire 1 moves in the width direction of the magnetic thin ribbons 2 and 3, the contact of the magnetic wire 1 with the magnetic thin ribbons 2 and 3 may be incomplete. Alternatively, if the adhesive layer is provided only on the tape base 5 disposed on the magnetic wire 1, air accumulates on the surface of the magnetic thin ribbons having no adhesive layer. When such a label is affixed to an article, the contact of the magnetic wire 1 with the magnetic thin ribbons 2 and 3 may be incomplete due to an expansion of the air accumulation accompanying with time passing.

In the antitheft label of the present invention, the tape base 4 disposed on the surface side of the label preferably comprises a paper.

The tape base 4 disposed on the surface side of the label is preferably made of a high quality paper, a middle quality paper or the like. Further preferred examples of the base material include gravure paper which has been machined-calendered or supercalendered to enhance the surface smoothness thereof, art paper obtained by applying a coating containing a pigment, an adhesive and auxiliary chemicals to a high quality paper or middle quality paper to enhance the printability thereof, and coated paper. Art paper and coated paper enhance the shielding of the label.

The thickness of the tape base 4 disposed on the surface side is preferably from 20 $\mu$m to 100 $\mu$m. If the thickness of the tape base 4 is less than 20 $\mu$m, the effect of a dark color pigment incorporated into the adhesive coated on the tape base 5 blackens the surface of the label, thus blurring a display such as a printed image or letter. Furthermore, if the label which the thickness of the tape base 4 is less than 20 $\mu$m is affixed to an article, the label may be broken. On the contrary, if the thickness of the tape base 4 is more than 100 $\mu$m, the rigidity of the label is so high that the label can curl up (peel of by it self) when affixed to merchandise having a curvature.

A bar code, price, notice, etc. can be printed on the tape base 4 disposed on the surface side. The printing further prevents the antitheft label from being exposed. Furthermore, if a bar code is printed thereon, a multifunctional label which can fulfill a POS function and an antitheft function in combination can be realized.

On the other hand, the tape base 5 preferably comprises a film of polyethylene, polyester, polypropylene or the like. The thickness of the tape base 5 is preferably from 20 $\mu$m to 100 $\mu$m.

Another preferred example of the tape base 5 is a colored tape. The color thereof is preferably a dark color such as black, dark blue, but the color is not particularly limited.

The adhesive incorporated into the antitheft label of the present invention is preferably a rubber, acrylic or silicone adhesive.

The thickness of the adhesive layers 7 and 8 is preferably from 5 $\mu$m to 40 m.

If the thickness of the adhesive layers 7 and 8 is less than 5 $\mu$m, the adhesive layers 7 and 8 lack adequate adhesion. This makes it difficult to realize fixed contact of the magnetic wire 1 with the magnetic thin ribbons 2 and 3.

On the other hand, if the thickness of the adhesive layers 7 and 8 is more than 40 $\mu$m, the adhesive can seep from the edge of the antitheft label. This is practically undesirable.

Examples of commercial adhesives for use in the adhesive layer 7 include P-22 (available from Shin Oji Seishi Corp.).

Furthermore, the tape base 4 or the tape base 5 may be a paper adhesive tape or film adhesive tape including an adhesive layer.

In order to facilitate adhesion of the antitheft label of the present invention to merchandise, an adhesive layer 9 is preferably disposed the sticking side of tape base 5 (i.e., the side of the label which is adhered to merchandise).

The adhesive incorporated into the adhesive layer 9, is preferably a rubber, acrylic or silicone adhesive. The thickness of the adhesive layer 9 is preferably from 25 $\mu$m to 40 $\mu$m.

Examples of commercial adhesives for use in the adhesive layer 9 include Movinyl UN94 (available from Hoechst Gosei K.K.) and JHL-23-59 (available from Hoechst Gosei K.K.).

On the other hand, the release paper 6 preferably comprises a paper tape having a thickness of from 40 $\mu$m to 80 $\mu$m treated with silicone or the like for easy release at least on the tape base 5 side.

The magnetic wire 1 preferably comprises a soft magnetic metallic material which exhibits Large Barkhausen Jump and has a length which exerts little demagnetizing effect. Preferred examples of such a soft magnetic metallic wire include amorphous metallic wire, Wiegand wire, and Fe—Si wire. Further, in order to provide an improved detection signal (e.g., pulse signal, harmonics), the magnetic wire may be subjected to a post-treatment such as heat treatment.

The coercive force of the material forming magnetic wire 1 is preferably from 0.05 to 1.0 Oe, more preferably from 0.1 to 0.6 Oe. In addition, the H* of the magnetic wire 1 is preferably from 0.01 to 0.9 Oe, more perferably from 0.05 to 0.5 Oe.

The H* of the antitheft label depends on the H* of the magnetic wire. If the H* of the magnetic wire exceeds 0.9 Oe, the H* of the antitheft label also exceeds 0.9 Oe. The antitheft label of the present invention produces a signal necessary for detection only when placed in a magnetic field exceeding its H*. Therefore, the H* of the magnetic wire preferably does not exceeds 0.9 Oe.

The diameter of the magnetic wire 1 is preferably from 60 to 115 μmφ, more preferably from 80 to 100 μmφ.

If the diameter of the magnetic wire 1 is less than 60 μmφ, the magnetic wire 1 has an insufficient sectional zone and thus tends to produce a low detection signal.

On the contrary, if the diameter of the magnetic wire 1 exceeds 115 μmφ, the resulting demagnetizing field is too high to exhibit Large Barkhausen Jump when the antitheft label has a practically desirable size. The length of the magnetic wire 1 is preferably from 15 mm to 40 mm, more preferably from 20 mm to 35 mm.

If the length of the magnetic wire 1 is less than 15 mm, the resulting demagnetizing field is too high to exhibit Large Barkhausen Jump.

On the other hand, if the length of the magnetic wire 1 exceeds 40 mm, the length of the entire antitheft label will exceed 50 mm. This makes it difficult or impossible to affixed the label to small-sized merchandise of different forms.

The magnetic thin ribbons 2 and 3 of the present invention are disposed on respective ends of the magnetic wire 1. The magnetic thin ribbons 2 and 3 preferably comprise a soft magnetic metallic material having a coercive force which is lower than that of the magnetic wire 1.

The coercive force of the magnetic thin ribbons 2 and 3 is preferably from 0.01 to 0.8 Oe. The soft magnetic metallic material preferably comprises Permalloy, silicon steel or an amorphous metallic material.

The magnetic flux change in the magnetic thin ribbons 2 and 3 markedly affects the reduction of the demagnetizing field of the magnetic wire 1. Accordingly, the magnetic thin ribbons 2 and 3 preferably have a length of from 3 to 20 mm in the longitudinal direction of the antitheft label, a width of from 3 to 10 mm and a thickness of from 10 to 50 μm.

If the length of the magnetic thin ribbons 2 and 3 is less than 3 mm, the effect of reducing the volume of the magnetic thin ribbons 2 and 3 or the rise in the demagnetizing field makes it difficult to obtain a magnetic flux required to reduce the demagnetizing field of the magnetic wire 1.

On the other hand, if the length of the magnetic thin ribbons 2 and 3 exceeds 20 mm, the length of the entire antitheft label is so great that it is difficult to affix the label to small-sized merchandise of different forms.

Furthermore, if the width and thickness of the magnetic thin ribbons 2 and 3 is less than 3 mm and 10 μm, respectively, the sectional area contributing to the magnetic flux change is inadequate to provide Large Barkhausen Jump.

On the contrary, if the width and thickness of the magnetic thin ribbons 2 and 3 exceed 10 mm and 50 μm, respectively, the magnetic thin ribbons 2 and 3 show increased rigidity. Accordingly, the antitheft label can curl up when affixed to a curved article (merchandise).

The shape of the magnetic thin ribbons 2 and 3 is not specifically limited, but may have the shape of a rectangle as shown in FIG. 1 or a polygon or a circle.

With respect to positioning the magnetic wire 1 and the magnetic thin ribbons 2 and 3, the ends of the magnetic wire 1 are preferably present within ±25% of the distance between the center and the end of the magnetic thin ribbons 2 and 3 in the longitudinal and crosswise direction of the antitheft label.

When the antitheft label of the present invention having Large Barkhausen Jump is exposed to an alternating magnetic field, it exhibits a steep magnetic flux change at a predetermined threshold value H* to produce a highly harmonic detection signal having a high output voltage. Such a highly harmonic detection signal having a high output voltage enhances the sensitivity of the detection system. Furthermore, this signal helps distinguish the antitheft label from other metallic materials.

Furthermore, in the antitheft label of the present invention, the adhesive layer 8 disposed on the laminated side of the tape base 5 comprises a pigment as in the foregoing constitution to conceal the magnetic wire and the magnetic thin ribbons from external view.

The pigment incorporated into the adhesive layer 8 is preferably a dark color pigment containing carbon black. The dark color may be a color which exhibits little light reflectance and a low saturation. Specific examples thereof include black, dark blue, and blue.

The pigment incorporated into the adhesive layer 8 more preferably is a mixture of the foregoing dark color pigment and a white pigment. A dark color pigment mixed with a white color pigment can provide a sharp image when printed on the tape base 4 disposed on the surface side.

Examples of the white pigment include titanium white, and zinc white.

The mixing ratio of the dark color pigment and the white pigment (by weight) depends on the kind of pigments used. For example, if carbon black is used as a dark color pigment and titanium white is used as a white pigment, the weight ratio of carbon black to titanium white is preferably from 1:50 to 1:100.

The pigment content is preferably from 0.001 to 10%, more preferably from 0.01 to 5% based on the weight of the adhesive.

If the pigment content is less than 0.001% based on the weight of the adhesive, it may be insufficient to conceal the detection member. On the other hand, if the pigment content exceeds 10%, the adhesion of the adhesive is reduced which makes it difficult to laminate the detection member.

The thickness of the adhesive layer 8 is preferably from 15 μm to 35 μm.

Furthermore, in the present invention, a commercial adhesive containing a dark color pigment and a white pigment may also be used as the adhesive layer 8. Examples of the commercial adhesive include a correcting black paste (available from Tack System Co., Ltd.).

EXAMPLES

The present invention will be further described in the following Examples and comparative Examples, however the present invention should not be construed as being limited thereto.

Example 1

Figure 2:
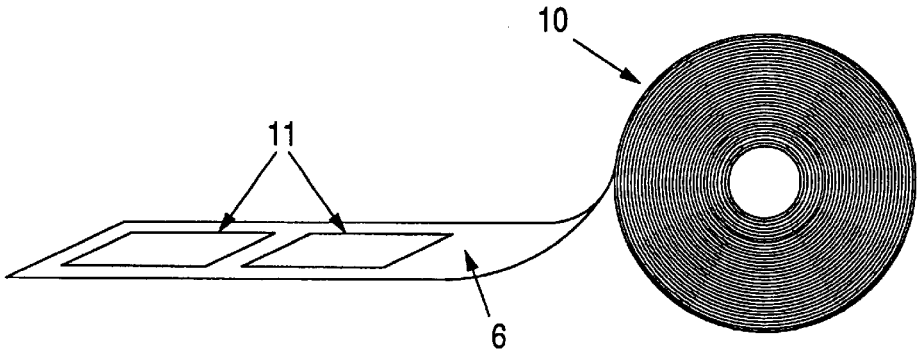
FIG. 2 is a schematic perspective view illustrating an embodiment of a label roll having thereon antitheft labels of the present invention arranged at an equal pitch.

An antitheft label was prepared having the configuration shown in FIG. 1. A wound label roll 10 was then prepared having a plurality of antitheft labels 11 arranged in line on a continuous release paper 6 at an equal pitch. FIG. 2 is a schematic perspective view illustrating the label roll.

The magnetic wire 1 used in Example 1 was a amorphous metallic wire having a diameter of 100 μmφ, a length of 27 mm and an alloy composition of $(Co_{50}Fe_{50})_{78}Si_9B_{13}$ (given in atomic percent). The magnetic thin ribbons 2 and 3 were amorphous thin ribbons having a length of 10 mm, a width of 7 mm, a thickness of 25 μm and an alloy composition of $Fe_{78}Si_9B_{13}$ (given in atomic percentage). The magnetic thin ribbons 2 and 3 were disposed on both ends of the magnetic wire 1, respectively, in close contact therewith.

Incidentally, the amorphous metallic wire was heat treated under tension after drawing but prior to use.

The coercive force of the magnetic wire 1 (length: 100 mm) and the magnetic thin ribbons 2 and 3 (length: 100 mm) in a sinusoidal magnetic field having a frequency of 50 Hz and an amplitude of 10 Oe was 0.20 Oe and 0.02 Oe, respectively.

The tape base 5 disposed on the sticking side was a double-sided adhesive polyethylene terephthalate (PET) tape having a thickness of 25 μm. An acryl emulsion adhesive containing two pigments, i.e., carbon black and titanium white (correcting black paste, available from Tack System Co., Ltd.) was used to form an adhesive layer 8 having a thickness of 25 μm and disposed on the laminated side.

The weight ratio of carbon black to titanium white was 1:80. The total content of these pigments was 4.05% of the weight of the adhesive.

As the adhesive layer 9 provided on the sticking side of the tape base 5 disposed on the sticking side of the label, an acrylic adhesive was used having a thickness of 32 μm (Movinyl UN94 available from Hoechst Gosei K.K.).

On the other hand, the tape base 4 disposed on the surface side, there was used a coated paper having a thickness of 80 μm. An acryl emulsion adhesive P-22 (available from Shin Oji Seishi Corp.) was used to form an adhesive layer 7 having a thickness of 10 μm disposed on the laminated side of the label.

The antitheft label thus prepared was then characterized with respect to BH (B: magnetic flux density; H: exciting magnetic field). For measuring BH, an alternating BH tracer AC BH-100K (available from Riken Denshi Co., Ltd.) was used. A sinusoidal magnetic field having a frequency of 50 Hz and an amplitude of 1 Oe was applied in the longitudinal direction of the label. Under these conditions, the magnetic flux change in the central part of the label was detected by a 100-turn detection coil.

Figure 3:
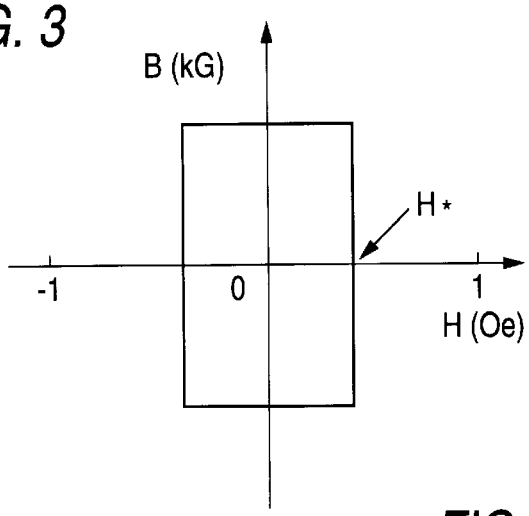
FIG. 3 is a diagram illustrating an example of a BH loop of the antitheft labels prepared in Examples 1 to 3.
Figure 4:
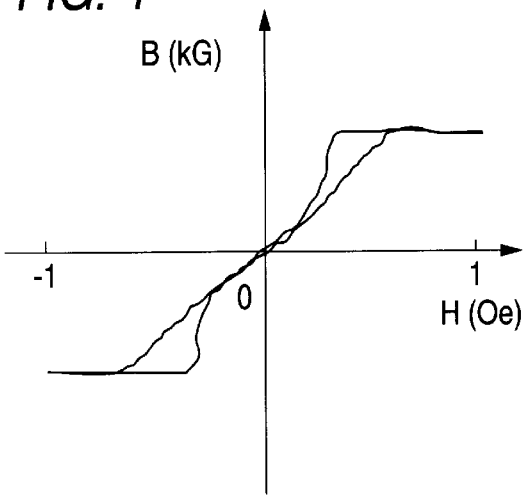
FIG. 4 is a diagram illustrating an example of a BH loop of an antitheft label merely constituted by a magnetic wire.

FIG. 3 illustrates the BH loop of the antitheft label of Example 1 as determined by the foregoing BH measurement. FIG. 4 illustrates the BH loop of an antitheft label constituted by a magnetic wire having a length of 27 mm alone and not closely contacting with magnetic thin ribbons provided on both ends thereof.

It is apparent that the antitheft label comprising a magnetic wire having a length of 27 mm alone does not provide Large Barkhausen Jump as shown in FIG. 4, whereas the antitheft label of Example 1 exhibits a distinct rectangular loop as shown in FIG. 3 and thus exhibits Large Barkhausen Jump. The H* of the antitheft label of the present invention prepared in Example 1 was about 0.25 Oe.

Figure 8:
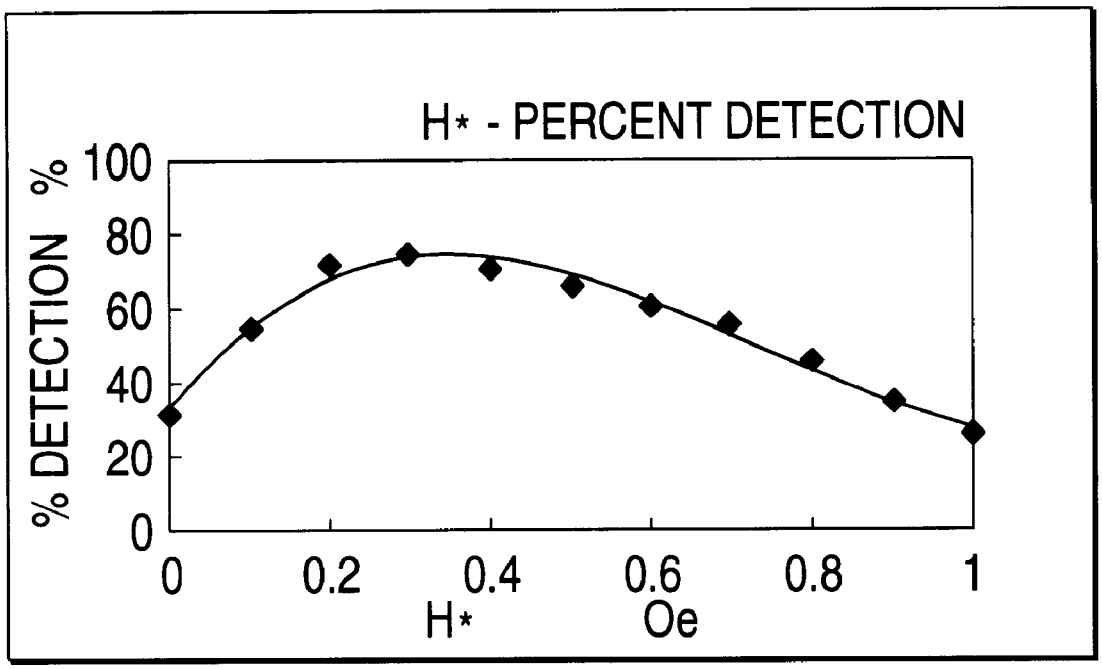
FIG. 8 is a diagram illustrating the relationship between H* of an antitheft label and the detection ratio by a detection system.

FIG. 8 illustrates the relationship between H* of an antitheft label and the detection ratio by a detection system. The term "detection ratio" as used herein means the proportion of the detected zone to the total zone of the detection gate. In general, an antitheft label preferably provides a detection ratio of not less than 70% to effectively monitor the theft of merchandise.

FIG. 8 shows that the antitheft label provides the highest percent detection when H* is 0.25 Oe. Thus, when H* falls within the range of from 0.2 to 0.4 Oe, the antitheft label reliably provides a percent detection of not less than 70% and thus exhibits stable Large Barkhausen Jump.

In the Examples of the present invention and comparative Examples, stability of the Barkhausen characteristics of the antitheft labels thus prepared was evaluated by the distribution of H*.

Figure 9:
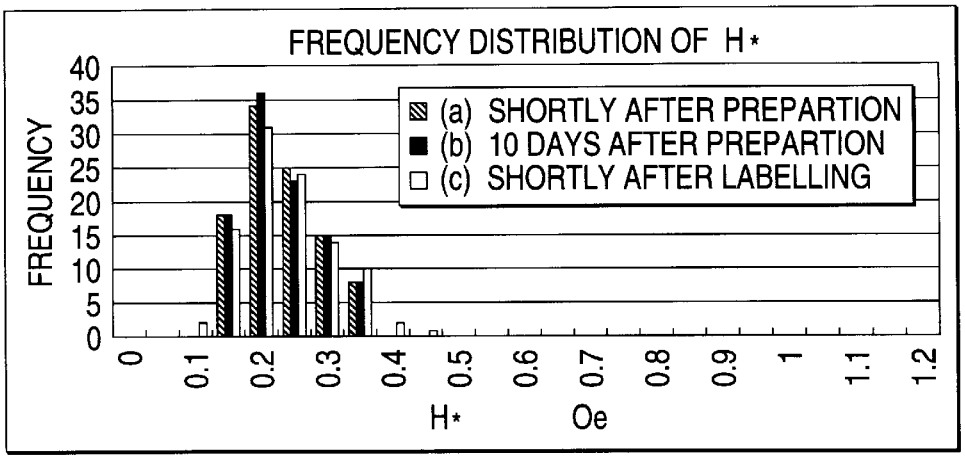
FIG. 9 is a diagram illustrating the frequency distribution of H* developed (a) shortly after preparing the antitheft label of Example 1, (b) 10 days after preparing the antitheft label, and (c) after affixing the antitheft label to an article in a labelling test.

FIG. 9 illustrates the frequency distribution of H* developed (a) shortly after preparing 100 antitheft labels in Example 1, (b) 10 days after preparing the antitheft labels (not affixed to articles), and (c) after affixing the antitheft labels to articles in a labelling test.

For the labelling test, the label roll 10 prepared in Example 1 was used. Using a label sticking machine JK-60 (available from Sensormatic Corp.), 100 label samples on the label roll were affixed to a cylinder having a curvature of 50 mmϕ. In addition to the shape of the BH loop, the extent to which the detection member was hidden from external view, the ease of affixing to label to the cylinder and the adhesion condition were also evaluated.

As a result, it was found that shortly after preparing labels and 10 days after preparing the labels, all of the samples exhibited a rectangular BH loop as shown in FIG. 3. Also, all of the samples had a H* in the range of from 0.2 to 0.4 Oe, thus providing reliably Large Barkhausen Jump as shown in FIG. 3.

It was furthermore found that even after affixing to the cylinder, no modification in BH loop was observed from all 100 samples, and 95% of all the samples had a H* in the range of from 0.2 to 0.4 Oe. This demonstrates that these labels reliably provide Large Barkhausen Jump even after affixed to the cylinder.

Furthermore, the labels affixed to the cylinder concealed the detection member (the magnetic wire 1 and magnetic thin ribbons 2 and 3) from external view.

In the process of affixing the labels, the labels were smoothly transferred from the roll to the cylinder. No adhesion defects such as label break and deviation were observed. Furthermore, none of the labels affixed to the cylinder curled up.

The labels prepared in Example 1 were affixed to articles having six different colors. The extent to which the detection member was hidden from external view was visually evaluated. The six colors were white, yellow, red, green, blue and black.

As a result, the detection member (the magnetic wire 1 and magnetic thin ribbons 2 and 3) in all the labels affixed to the articles having six different color could not be externally recognized.

Comparative Example 1

The procedure of Example 1 was followed to prepare an antitheft label and a label roll, except that instead of tape base 4 disposed on the surface side, a paper was used having a thickness of 15 μm which was free of an adhesive layer on the laminated side thereof. These samples were then subjected to a BH measurement and a labelling test in the same manner as in Example 1.

Figure 10:
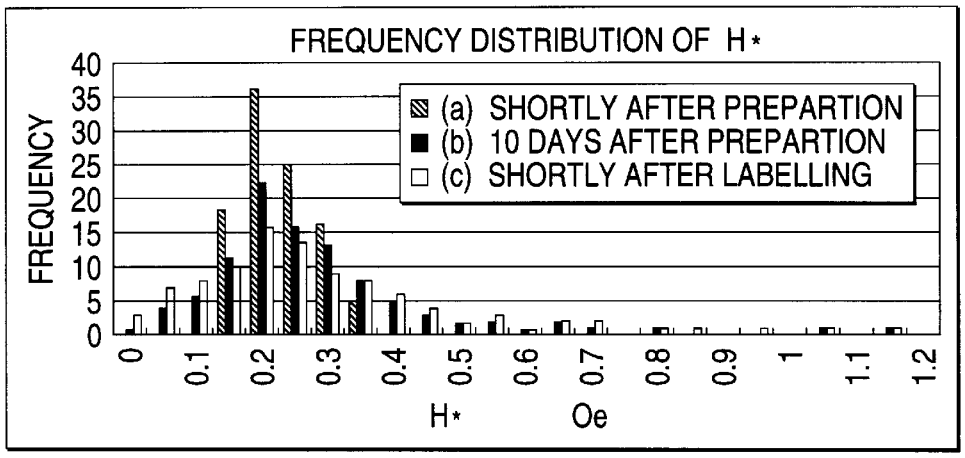
FIG. 10 is a diagram illustrating the frequency distribution of H* developed (a) shortly after preparing the antitheft label of Comparative Example 1, (b) 10 days after affixing the antitheft label, and (c) after affixing the antitheft label to an article in a labelling test.

FIG. 10 illustrates the frequency distribution of H* developed (a) shortly after preparing 100 antitheft labels in Comparative Example 1, (b) 10 days after preparing the antitheft labels (not affixed to articles) and (c) after affixing the antitheft labels to articles in a labelling test.

For the labelling test, the same label sticking machine JK-60 (available from Sensormatic Corp.) was used as in Example 1. 100 label samples on the label roll were affixed to a cylinder having a curvature of 50 mmϕ. Besides the shape of BH loop, the extent to which the member to be detected was hidden from external view, the ease of sticking and the sticking condition were evaluated.

Figure 5:
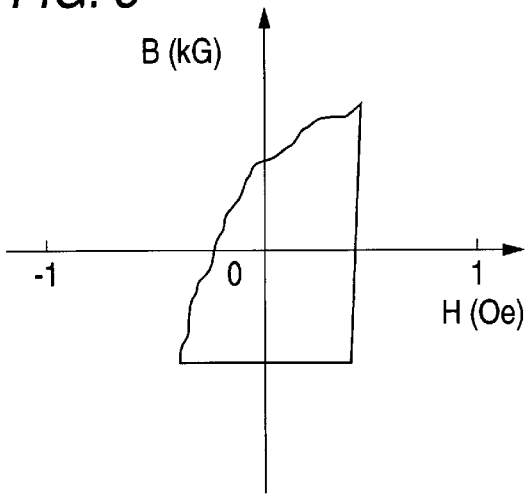
FIG. 5 is a diagram illustrating an example of a modified BH loop of the antitheft labels prepared in Comparative Examples 1 and 2.
Figure 6:
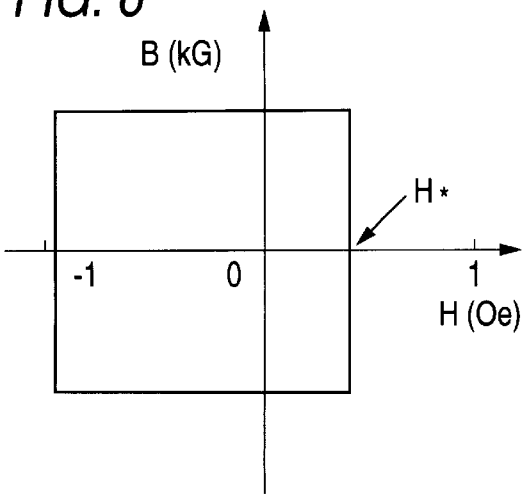
FIG. 6 is a diagram illustrating another example of modified BH loop of the antitheft labels prepared in Comparative Examples 1 and 2.
Figure 7:
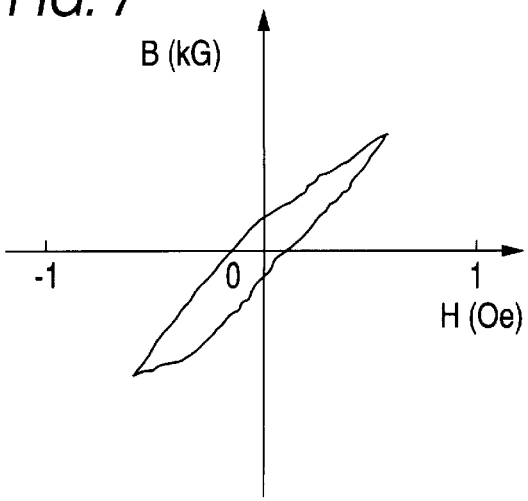
FIG. 7 is a diagram illustrating a further example of modified BH loop of the antitheft labels prepared in Comparative Examples 1 and 2.

Shortly after preparing the labels, all 100 samples exhibited a rectangular BH loop as shown in FIG. 3 and H* in the range of from 0.2 to 0.4 Oe. However, 10 days after preparing the labels, 15% of the 100 samples exhibited modified BH loops as shown in FIGS. 5 to 7 (an unstable BH loop having a lare Barkhausen inversion only on the positive or negative side in the magnetic field H as shown in FIG. 5; an asymmetric BH loop having an extremely large H* at the positive or negative side in the magnetic field H as shown in FIG. 6; or a BH loop completely free of Large Barkhausen Jump as shown in FIG. 7. 30% of the 100 samples exhibited an H* deviating from the range of from 0.2 to 0.4 Oe. Some samples exhibited an H* of greater than 1.0 Oe. 35% of all of the samples affixed to the cylinder exhibited modified BH loops. 43% of the 100 samples exhibited an H* deviating from the range of from 0.2 to 0.4 Oe. It was thus found that these antitheft labels widely varied in their characteristics.

The detection member to be detected (the magnetic wire 1 and magnetic thin ribbons 2 and 3) could not be externally recognized. However, because the tape base 4 disposed on the surface side did not have an adhesive layer, it had a reduced thickness. Thus, the surface of the antitheft label appeared blackish.

Furthermore, in the process of label sticking, 23% of the 100 label samples were broken.

The labels prepared in Comparative Example 1 were affixed to articles having six different colors. The extent to which the detection member was hidden from external view was visually evaluated. The six colors were white, yellow, red, green, blue and black.

As a result, detection member (the magnetic wire 1 and magnetic thin ribbons 2 and 3) in all the labels affixed to the articles having six different colors could not be externally recognized. However, the surface of the antitheft label appeared blackish.

Comparative Example 2

The procedure of Example 1 was followed to prepare an antitheft label and a label roll, except that instead of tape base 4 disposed on the surface side, a 150 μm thick paper was used comprising an adhesive layer on the laminated side thereof. Also, the tape base 5 disposed on the sticking side had an adhesive layer 9 only on the sticking side thereof. These samples were then subjected to a BH measurement and labelling test in the same manner as in Example 1.

Figure 11:
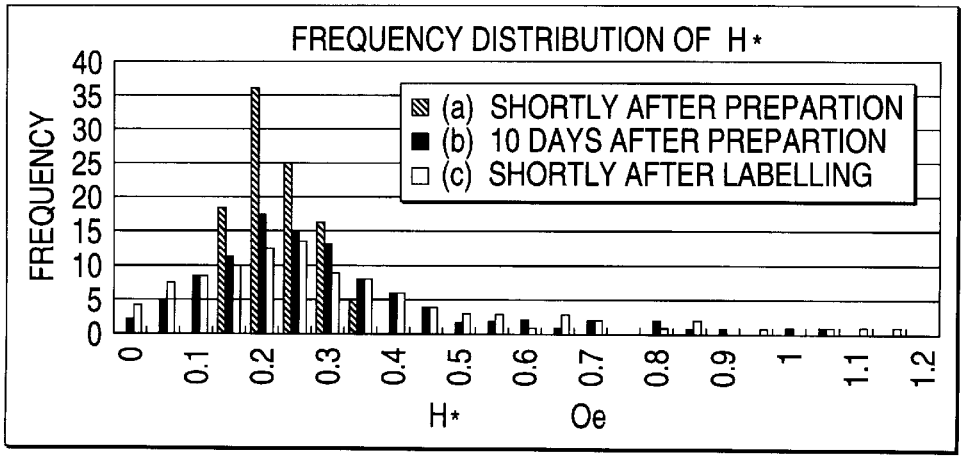
FIG. 11 is a diagram illustrating the frequency distribution of H* developed (a) shortly after preparing the antitheft label of Comparative Example 2, (b) 10 days after preparing the antitheft label, and (c) after affixing the antitheft label to an article in a labelling test.

FIG. 11 illustrates the frequency distribution of H* developed (a) shortly after preparing 100 antitheft labels in Comparative Example 2, (b) 10 days after preparing the antitheft labels (not affixed to articles) and (c) after affixing the antitheft labels to articles in a labelling test.

For the labelling test, the same label sticking machine JK-60 (available from Sensormatic Corp.) was used as in Example 1. 100 label samples on the label roll were affixed to a cylinder having a curvature of 50 mmϕ. Besides the shape of BH loop, the extent to which the detection member was hidden from external view, the ease of sticking and the sticking condition were evaluated.

Shortly after preparing the labels, all 100 samples exhibited a rectangular BH loop as shown in FIG. 3 and H* in the range of from 0.2 to 0.4 Oe. However, 10 days after preparing the labels, 28% of the 100 samples exhibited modified BH loops as shown in FIGS. 5 to 7. 41% of the 100 samples exhibited an H* deviating from the range of from 0.2 to 0.4 Oe. Some samples exhibited an H* of greater than 1.0 Oe, while others exhibited an H* of less than 0.1 Oe. 38% of the samples affixed to the cylinder exhibited modified BH loops. 48% of the 100 samples exhibited an H* deviating from the range of from 0.2 to 0.4 Oe. It was thus found that these antitheft labels widely varied in their characteristics.

The magnetic wire 1 of the labels affixed to the cylinder could not be externally recognized. However, the labels affixed to the cylinder failed to conceal the magnetic thin ribbons 2 and 3.

Furthermore, in the process of label sticking, 7% of the 100 label samples were observed to have deviated or miscarried.

Shortly after being affixed to the cylinder, 15% of the 100 label samples could be curled up at both ends thereof. After 2 hours, almost all of the 100 label samples were curled up.

The labels prepared in Comparative Example 2 were affixed to articles having six different colors. The extent to which the detection member was hidden from external view was visually examined. As a result, the labels affixed to black and blue articles could barely conceal the detection member (the magnetic wire 1 and magnetic thin ribbons 2 and 3). However, the magnetic thin ribbons 2 and 3 externally could be seen on the labels affixed to green and red articles. Furthermore, the magnetic wire 1 and the magnetic thin ribbons 2 and 3 could readily be seen on the labels affixed to yellow and white articles.

Example 2

An antitheft label having the configuration shown in FIG. 1 was prepared in the same manner as in Example 1.

The magnetic wire 1 used in Example 2 was a amorphous metallic wire having a diameter of 100 μmϕ, a length of 27 mm and an alloy composition of $(Co_{50}Fe_{50})_{78}Si_9B_{13}$ (given in atomic percent). The magnetic thin ribbons 2 and 3 were amorphous thin ribbons having a length of 10 mm, a width of 7 mm, a thickness of 25 μm and an alloy composition of $Fe_{78}Si_9B_{13}$ (given in atomic percentage). The magnetic thin ribbons 2 and 3 were disposed on the both ends of the magnetic wire 1, respectively, in close contact therewith.

The foregoing amorphous metallic wire was heat treated under tension after drawing but prior to use.

The coercive force of the magnetic wire 1 (length: 100 mm) and the magnetic thin ribbons 2 and 3 (length: 100 mm) in a sinusoidal magnetic field having a frequency of 50 Hz and an amplitude of 10 Oe was 0.20 Oe and 0.02 Oe, respectively.

A double-sided adhesive PET tape having a thickness of 25 μm was used as the tape base 5. As the adhesive layer 8, an acrylic emulsion adhesive was used to form the adhesive layer 8 having a thickness of 25 μm.

As the adhesive layer 9 of the tape base 5, an acrylic adhesive (Movinyl UN 94 available from Hoechst Gosei K.K.) was used.

On the other hand, as the tape base 4 on the surface side, a coat paper having a thickness of 80 μm was used. As the adhesive P-22 (available from Shin Oji Seishi Corp.) was used to form the adhesive layer 7 having a thickness of 10 μm.

The antitheft label thus prepared was then characterized with respect to BH.

As a result, all of the 100 label samples exhibited a rectangular BH loop as shown in FIG. 3 and in Example 1. There was no change in the rectangular loop even 10 days after preparing the samples.

Also, shortly after preparing the labels and 10 days after preparing the labels, all of the 100 samples exhibited an H* in the range of from 0.2 to 0.4 Oe, thus providing reliably Large Barkhausen Jump.

Furthermore, none of the 100 label samples exhibited a modified BH loop even when affixed at a curvature of 50 mmϕ, thus demonstrating that the antitheft label exhibits invariably Large Barkhausen Jump even when affixed to a curved article.

Example 3

As similar to the first Example, an antitheft label was prepared.

The magnetic wire 1 used in Example 3 was a amorphous metallic wire having a diameter of 94 $\mu m^4$, a length of 30 mm and an alloy composition of $(Co_{50}Fe_{50})_{78}Si_9B_{13}$ (given in atomic percent). the magnetic thin ribbons 2 and 3 were disposed on both ends of the magnetic wire 1, respectively, in close contact therewith.

The coercive force of the magnetic wire 1 (length: 100 mm) and the magnetic thin ribbons 2 and 3 (length: 100 mm) in a sinusoidal magnetic filed having a frequency of 50 Hz and an amplitude of 10 Oe was 0.30 Oe and 0.02 Oe, respectively.

The tape base 5 disposed on the sticking side was a double-sided adhesive PET tape having a thickness of 25 $\mu$m. An acrylic emulsion adhesive containing two pigment, i.e., carbon black and titanium white (correcting black paste, available from Tack System Co., Ltd.) was used to form an adhesive layer 8 having a thickness of 25 $\mu$m and disposed on the laminated side.

As the adhesive layer 9 of the tape base 5, an acrylic adhesive (Movinyl UN94 available from Hoechst Gosei K.K.) was used.

On the other hand, as the tape base 4 on the surface side, a coat paper having a thickness of 80 cm was used. As the adhesive layer 7 on the laminated side, an acrylic emulsion adhesive P-22 (available from Shin Oji Seishi Corp.) was used to form the adhesive layer 7 having a thickness of 10 $\mu$m.

The antitheft label thus prepared was used to carry out BH measuring.

As a result, all of the 100 label samples exhibited a rectangular BH loop as shown in FIG. 3 and in Examples 1 and 2. There was no change in the rectangular even 10 days after preparing the samples.

Also, shortly after preparing the labels and 10 days after preparing the labels, all of the 100 samples exhibited on H* in the range of from 0.2 to 0.4 Oe, thus providing reliably Large Barkhausen Jump.

Furthermore, none of the 100 label samples exhibited a modified BH loop even when affixed at a curvature of 50 mmϕ, thus demonstrating that the antitheft label exhibits reliably Large Barkhausen Jump even when affixed to a curved article.

Furthermore, the 100 label samples prepared in Example 3 were subjected to a labelling test in the same manner as in Example 1. The detection member (the magnetic wire 1 and magnetic thin ribbons 2 and 3) could not be seen through the affixed label samples.

Additionally, no defects were observed in the process of label sticking. That is, none of the label samples were found to be broken or deviated. Further, none of these label samples curled up one they were affixed.

The labels prepared in Example 3 were affixed to articles having six different colors. The extent to which the detection member was hidden from external view was evaluated. The six colors were white, yellow, red, green, blue and black.

As a result, the detection member (the magnetic wire 1 and magnetic thin ribbons 2 and 3) could not be seen through all of the labels affixed to the articles having six different colors.

What is claimed is:

1. An antitheft label which generated a large Barkhausen inversion when subjected to a magnetic field, said antitheft label comprising a laminate of upper and lower tape bases each having an inner laminated surface and an outer surface, a first adhesive layer disposed on the inner surface of said upper tape base, a second adhesive layer disposed on the inner surface of said lower tape base, a pulse-generating magnetic wire and first and second magnetic thin ribbons disposed on opposite ends of said magnetic wire, wherein said magnetic wire and magnetic thin ribbons are arranged between said upper and lower tape bases.

2. The antitheft label as claim in claim 1, wherein the side of the antitheft label comprising the lower tape base is to be affixed to an article of merchandise, and the second adhesive layer disposed on the inner surface of said lower tape base comprises a pigment.

3. The antitheft label as claim in claim 1, wherein the upper tape base comprises a paper.

4. The antitheft label as claim in claim 1, further comprising a third adhesive layer disposed on the outer surface of said lower tape base.

5. The antitheft label as claim in claim 1, wherein the upper tape base has a thickness of from 20 to 100 $\mu$m.

6. The antitheft label as claim in claim 1, wherein the lower tape base has a thickness of from 20 to 100 $\mu$m.

7. The antitheft label as claim in claim 1, wherein said first and second adhesive layers have a thickness of from 5 to 40 $\mu$m.

8. The antitheft label as claim in claim 1, wherein the magnetic wire has an H* of from 0.01 to 0.9 Oe.

9. The antitheft label as claim in claim 1, wherein the magnetic wire is selected from an amorphous metallic wire and a Fe—Si wire.

10. The antitheft label as claim in claim 1, wherein the magnetic wire has a diameter of from 60 to 115 $\mu$mϕ.

11. The antitheft label as claim in claim 1, wherein the magnetic wire has a length of from 15 to 40 $\mu$mm.

12. The antitheft label as claim in claim 1, wherein said first and second magnetic thin ribbons comprise a soft magnetic material having a coercive force which is less than that of the magnetic wire.

13. The antitheft label as claim in claim 1, wherein said first and second magnetic ribbons have a coercive force of from 0.01 to 0.080e.

14. The antitheft label as claim in claim 1, wherein said first and second magnetic thin ribbons have a length of from 3 to 20 mm in the longitudinal direction of the antitheft label, a width of from 3 to 10 mm and a thickness of from 10 to 50 $\mu$m.

15. The antitheft label as claim in claim 1, wherein said first and second magnetic thin ribbons have the shape of a rectangle, a polygon or a circle.

16. The antitheft label as claim in claim 1, wherein the ends of the magnetic wire are present within ±25% of the distance between the center and the end of the magnetic thin ribbons in the longitudinal and crosswise direction of the antitheft label.

17. The antitheft label as claim in claim 3, wherein said pigment is a dark colored pigment comprising carbon black.

18. The antitheft label as claim in claim 3, wherein said second adhesive layer contains a pigment in an amount of from 0.001 to 10 weight %.

19. An article of merchandise having an antitheft label affixed thereto which generates a high Barkhausen inversion when subjected to a magnetic field, said antitheft label comprising a laminate of upper and lower tape bases each having an inner laminated surface and an outer surface, a first adhesive layer disposed on the inner surface of said upper tape base, a second adhesive layer disposed on the inner surface of said lower tape base, a pulse-generating magnetic wire and first and second magnetic thin ribbons disposed on opposite ends of said magnetic wire, wherein said magnetic wire and magnetic thin ribbons are arranged between said upper and lower tape bases.

20. The article of claim 19, wherein the outer surface of said lower tape base is affixed to the article of merchandise and the second adhesive layer disposed on the inner surface of said lower tape base comprises a pigment.

* * * * *